US005299282A

United States Patent [19]

Tabei

[11] Patent Number: 5,299,282

[45] Date of Patent: Mar. 29, 1994

[54] RANDOM TONE OR VOICE MESSAGE SYNTHESIZER CIRCUIT

[75] Inventor: Kazuhiko Tabei, Tokyo, Japan

[73] Assignee: NEC Corporation, Tokyo, Japan

[21] Appl. No.: 830,226

[22] Filed: Jan. 31, 1992

[30] Foreign Application Priority Data

Feb. 8, 1991 [JP] Japan ..... 3-017253

[51] Int. Cl.[5] ..... G10L 9/00

[52] U.S. Cl. ..... 395/2.79; 395/2.67

[58] Field of Search ..... 381/51-53; 395/2.79, 2.67; 331/3, 78

[56] References Cited

U.S. PATENT DOCUMENTS

| | | | |
|---|---|---|---|
| 4,491,958 | 1/1985 | Umemura et al. | 381/51 |
| 4,641,102 | 2/1987 | Coulthart et al. | 331/78 |
| 4,658,424 | 4/1987 | Henderson | 381/51 |
| 4,799,171 | 1/1989 | Cummings | 381/51 |
| 4,945,805 | 8/1990 | Hour | 381/51 |

*Primary Examiner*—Michael R. Fleming

*Assistant Examiner*—Michelle Doerrler

*Attorney, Agent, or Firm*—Whitham & Marhoefer

[57] ABSTRACT

A message synthesizer circuit includes a compressed message data memory as a message source for storing a plurality of compressed message data of message, each corresponding to a message code specifying a message to be emitted as a synthesized message. An input message code selector converts a message code signal into the count of a ring counter by taking, as its inputs, a count output emitted from the ring counter, with the total number of these compressed message data corresponding to its maximum count number, a message code signal for specifying a message to be emitted and an input message code selector signal for setting a randomizing condition for randomly altering the message code signal. The system controller reads out the compressed message data corresponding to the random message code from the compressed message data memory, which is then converted into a specific synthesized message.

4 Claims, 2 Drawing Sheets

RANDOM TONE OR VOICE MESSAGE SYNTHESIZER CIRCUIT

BACKGROUND OF THE INVENTION

1. Field of the Invention

The present invention relates to a message synthesizer circuit, and more particularly to a synthesizer circuit which can generate a desired tone or voice message.

2. Prior Art

As shown in FIG. 1, in a conventional message synthesizer circuit, a melody, for example, an eight-bit data representation for a single tone of the piano, is turned into compressed PCM data to store into a memory 11, which serves as a message source, and the PCM data is sequentially read out to reproduce the melody by means of a PCM decoder 12. While for speech, a single message such as "Ohayou (Good morning)" is similarly compressed into ADPCM (Adaptive Differential Pulse Code Modulation) or DPCM (Differential Pulse Code Modulation) data to store into a compressed message data memory 11, which serves as the message source. In this case, the basic bit processing systems are the same, whether a single message frame such as "Ohayou" be stored as a single block of data, or "o", "ha", "yo" and "u" be each stored as the unit tone. Incidentally, in the case of a PARCOR (Partial Autocorrelation) system, a specific PARCOR data processing is used. However, in either case, the compressed message data memory 11 is provided as the message source for storing the compressed message data.

In operation of the conventional message sysnthesizer circuit, a message code signal 109 for specifying a message is entered, and a start signal 110 is entered to latch the message code signal by a latch circuit 9, and then the compressed message data specified by the message code signal 109 is read out from the specified address of the compressed message data memory 11 by a system controller 10. The compressed message data which has been read out is expanded and decoded by a compressed message data decoder (PCM decoder) 12 and, after conversion into an analog signal by a D/A (digital-to-analog) converter 13, it is passed through a message demodulating filter or a low pass filter 14 to emit a synthesized message for obtaining a specific message.

In some applications (for example, a toy and the like) of the above-described conventional message synthesizer circuit, variations such as "Ohayou", "Konnichiwa (Hello)" or "Konbanwa (Good evening)" are often needed as casual and random message data outputs rather than "Ohayou", which is the stereotyped message data.

However, in the above-described conventional message synthesizer circuit, in order to achieve any random message output, it is necessary to enter a corresponding message code signal from the exterior and, accordingly, for that purpose, an external circuit becomes necessary.

SUMMARY OF THE INVENTION

An object of the present invention is to eliminate such a drawback and provide a message synthesizer circuit which is simply arranged so that any arbitrary message to be emitted may be randomly selected from among a plurality of messages.

According to the present invention, there is provided a message synthesizer circuit which comprises compressed message data storing means for storing a plurality of compressed message data each corresponding to a plurality of message codes, ring counter means for counting rings in synchronism with a predetermined clock signal to emit a count data with the total amount of the plurality of compressed message data corresponding to its maximum count number, message code selector means for randomly altering an array of the count data emitted from the ring counter means, which corresponds to the message code signal, to change into a random message code signal, means for reading out the compressed message data corresponding to the random message code signal from a corresponding area of the compressed message data storing means, means for decoding the compressed message data read out from the compressed message data storing means, and means for converting the decoded data from digital into analog form to emit a synthesized message.

In the message synthesizer circuit according to this invention, a plurality of compressed message data corresponding to a plurality of message codes is previously stored within the compressed message data memory, which is the message source, and an input message code selector converts a message code signal into a count of the ring counter by entering the count number of the ring counter, which emits the count output data in synchronism with the clock signal within the system, a message code signal for specifying any specific message and an input message code selector signal for setting a condition for randomly altering the message code signal. The array of those counts is altered according to how the input message code selector signals are set, to obtain a random message code signal to enter to a system controller. The system controller reads out any compressed message data corresponding to the random message code signal from the memory to decode by a compressed message data decoder so that it is passed through a filter as the analog signal by a D/A converter to obtain a synthesized message.

Therefore, a circuit for setting a randomizing condition can be eliminated and, if it is applied to voice uttering toys or the like, their character can be enriched by the unexpected voice utterance effect.

The present invention will be hereinafter described in greater detail with reference to the accompanying drawings.

DETAILED DESCRIPTION OF THE PREFERRED EMBODIMENT

Figure 1:
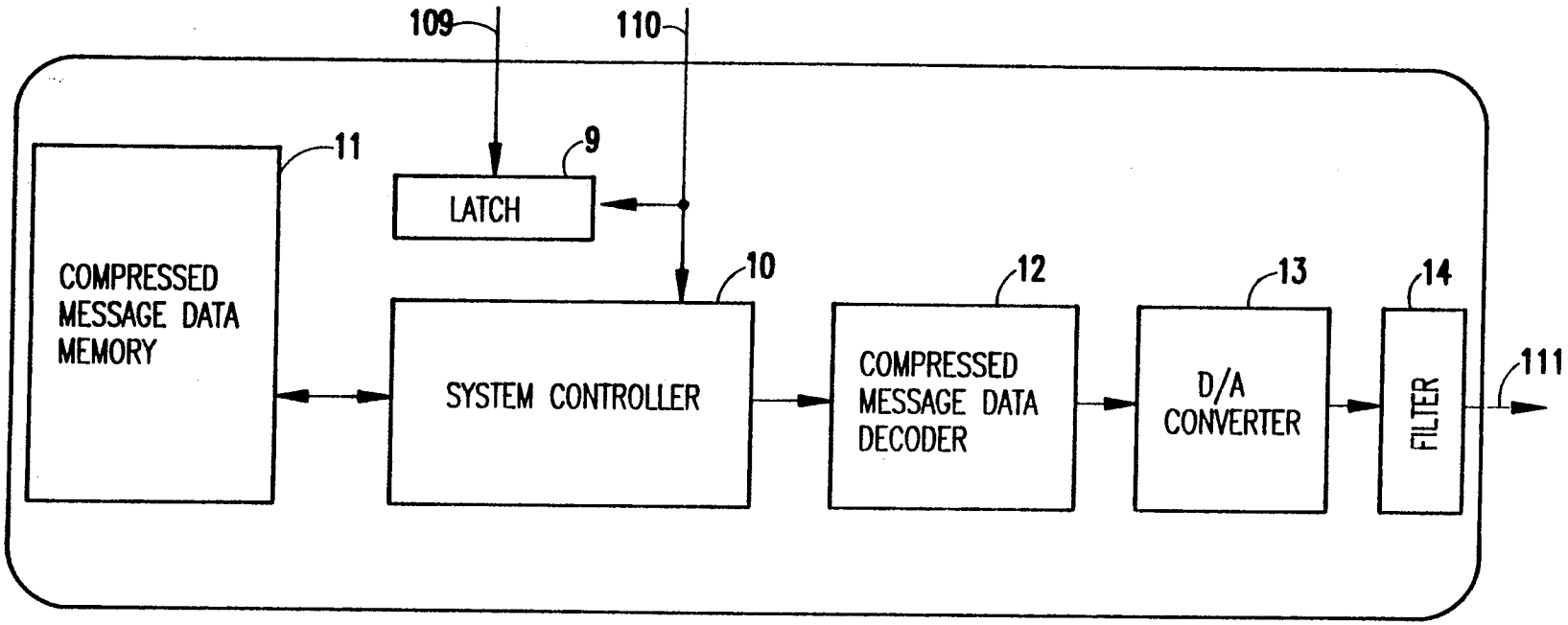
FIG. 1 PRIOR ART
FIG. 1 is a block diagram of a conventional message synthesizer circuit.
Figure 2:
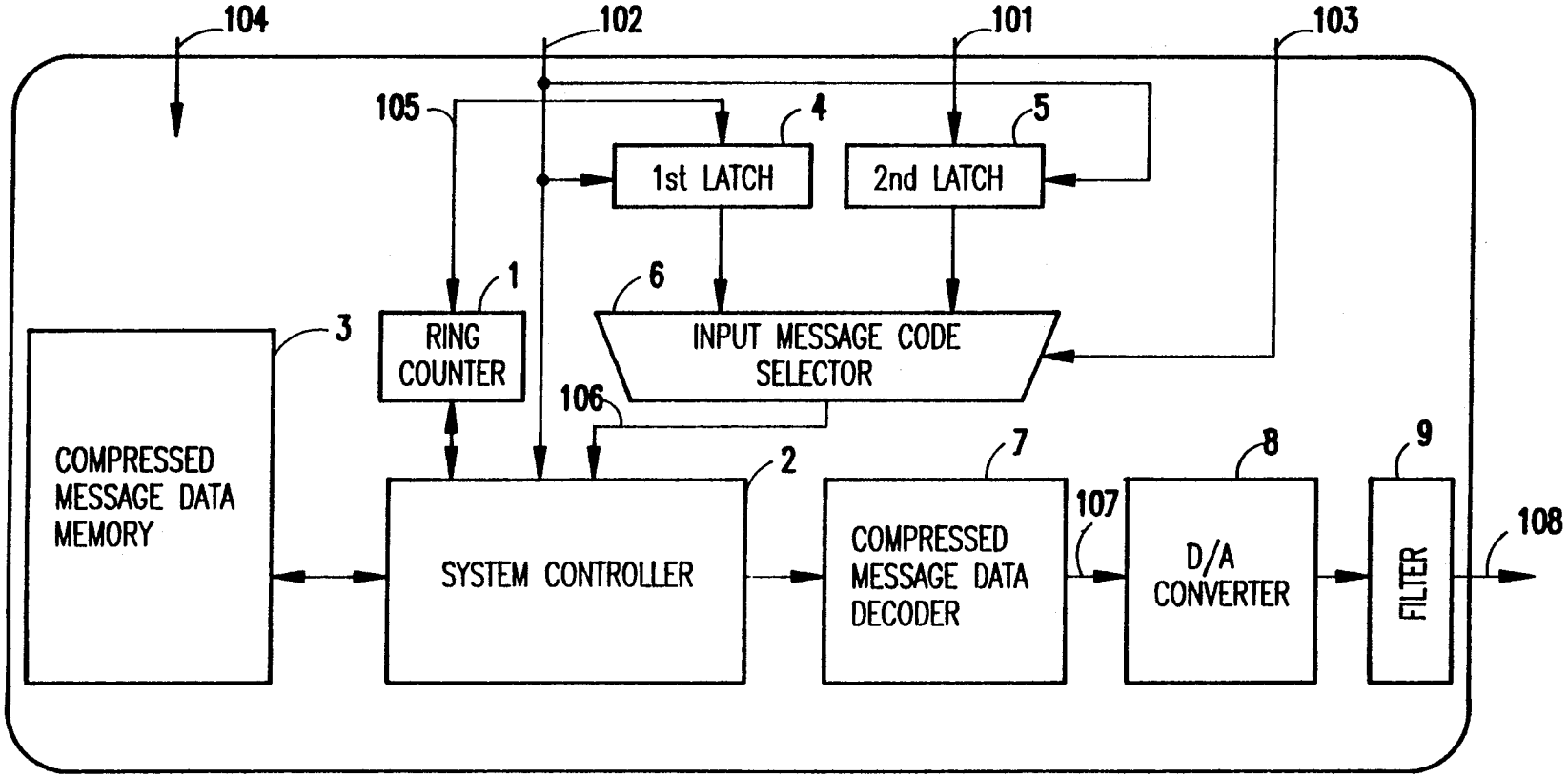
FIG. 2 is a block diagram of a message synthesizer circuit according to a specific embodiment of the present invention.

Referring now to FIG. 2 which illustrates a message synthesizer circuit according to this invention, reference numeral 1 denotes a ring counter for emitting the number of the data stored in a compressed message data memory 3 as its maximum count number in synchronism with a predetermined clock 104. 2 denotes a system controller for entering the data 105 emitted from the ring counter 1 as a message code signal 106 to read out a corresponding compressed message data. The compressed message data memory 3, which is a message source, is provided for storing a plurality of PCM processed compressed message data. 4 denotes a first latch circuit for latching the output of the ring counter 1, and 5 denotes a second latch circuit for latching an external message code signal 101. The latch circuits 4 and 5 operate in accordance with a start signal 102.

The numeral 6 denotes an input message code selector for converting the code of the external message code signal 101 into the count output of the ring counter 1 to emit the message code signal 106 randomly converted by means of the input message code selector signal for setting a randomizing condition. 7 denotes a PCM decoder or compressed speech data decoder provided for, after expanding and decoding the compressed message data read out by the system controller 2, conducting other data processing to return to the original digital message signal 107. 8 denotes a D/A converter for converting the decoded digital message signal 107 into an analog signal, thereby to generate a speech message 108 through a filter 9 which demodulates the message.

In the operation of the above-described arrangement, the external message code signal 101 is entered to the second latch circuit 5 to specify a code representing a message such as "Ohayou" or "Kon-nichiwa", which is entered from the exterior and, after the output data 105 from the ring counter 1 is entered to the latch circuit 4, in synchronism with the clock 104 from the clock circuit of the system. The input message code selector signal 103 is entered to the message code selector 6 so as to select the output of the ring counter 1, which is replaced for the code signified by the external message code signal 101.

When the start signal 102 is entered, at the latch circuits 4 and 5, each input data, that is, the data 105 emitted from the ring counter and the external message code signal 101 are latched to be entered to the input message code selector 6.

At the input message selector 6, after the message code signal 101 is replaced by the count number of the output 105 of the ring counter 1, which corresponds to the data amount of the compressed message data memory 3, it is selected by the input message code selector signal 103, and the data 105 emitted by the ring counter is changed in its array so as to be entered to the system controller 2 in the form of the random message code signal 106.

In order to generate the input message code selector signal 103 for reselecting a random array of the message code signal, by utilizing the aforementioned clock 104, the signal 106 may be multiplied and demultiplied by a factor of n to generate a random timing as logically processed data, or may be looped along an unpredicted value.

At any rate, the procedure and the timing to be used may be appropriately set in a random manner depending on whether the data to be randomly changed is represented per unit of the tone data, word, or message as the block data.

In addition, the start signal 102 is directly entered to the system controller 2 and, at the same time it is entered, a plurality of randomly arrayed message code signals 106 is recognized so that a plurality of corresponding compressed message data is read out from the message data memory 3. The compressed message data which has been read out is entered to the compressed message data decoder 7, where a reversed sequence of the message recording and other processes conducted when it is stored into the memory is followed.

For the data which was subjected to the ADPCM process and stored within the compressed message data memory 3, it is subjected to a time base converting process to expand the compressed data to return to an original digital pulse train by the decoding process of the pulse code modulated data. While, for the PARCOR processed data, it is subjected to a specific restoring and synthesizing process, in which various data processing such as correcting any bit error is done, so that the A/D converted pulse train 107, which is used at the time of recording, is decoded. After conversion into the analog signal by the D/A converter 8, the decoded pulse train is passed through the message demodulating filter 9 to obtain an output 108 representing a specific synthesized message.

As described above, by randomizing the setting of the input message code selector signals 103, if the message source which genarates a melody is used, then it can be turned into a mysterious one. Alternatively, when a message source generates a speech message, by rearranging the messages or words, any modification or accent may be added thereby enriching the character of the model. In addition, referring further to the randomizing function, the number of circuits can be reduced as compared with the system in which any setting circuit applying a fuzziness concept is added to the external circuit.

What is claimed is:

1. A message synthesizer circuit comprising:

compressed message data storing means for storing a plurality of compressed message data, each corresponding to a plurality of message codes;

ring counter means for emitting a count data by counting rings in synchronism with a predetermined clock signal with the total number of said plurality of compressed message data corresponding to a maximum count number of said ring counter means;

input means connected to receive an external input message code signal asynchronously with the operation of said ring counter means;

message code selector means connected to receive the count data from said ring counter means and the external input message code signal from said input means for randomly altering an array of count data emitted from said ring counter means, which corresponds to a specific message code signal, to convert said count data into random message code signal;

means for reading out the compressed message data corresponding to said random message code signals from a corresponding area of said compressed message data storing means; and means for decoding said compressed message data read out from said compressed message data storing means and a means for converting said decoded data from digital into analog form to emit a specific synthesized message.

2. The message synthesizer circuit according to claim 1 wherein said message code selector means comprises a first latch means for latching a count of said ring counter and a second latch means for latching said message code signal.

3. The message synthesizer circuit according to claim 1, wherein said compressed messages stored in said compressed message data storing means are word messages comprising a plurality of phrases having no substantial relationship therebetween and said synthesizer circuit synthesizes random speech messages.

4. The message synthesizer circuit according to claim 1, wherein said compressed messages stored in said compressed message data storing means are tone signals and said synthesizer circuit synthesizes random melodies.

* * * * *